US012605584B2

(12) United States Patent
Zheng et al.

(10) Patent No.: US 12,605,584 B2
(45) Date of Patent: Apr. 21, 2026

(54) MULTI-MOTOR FITNESS DEVICE

(71) Applicant: Guangdong Wanrui Electromechanical Technology Co., Ltd, Dongguan (CN)

(72) Inventors: Shengju Zheng, Dongguan (CN); Yuanzhi Hu, Dongguan (CN); Meiyu Zheng, Dongguan (CN)

(73) Assignee: Guangdong Wanrui Electromechanical Technology Co., Ltd, Dongguan (CN)

( * ) Notice: Subject to any disclaimer, the term of this patent is extended or adjusted under 35 U.S.C. 154(b) by 86 days.

(21) Appl. No.: 18/893,945

(22) Filed: Sep. 23, 2024

(65) Prior Publication Data

US 2025/0387660 A1 Dec. 25, 2025

(30) Foreign Application Priority Data

Jun. 25, 2024 (CN) ..... 202410824018.7

(51) Int. Cl.
*A63B 21/00* (2006.01)
*A63B 21/005* (2006.01)
*A63B 21/16* (2006.01)

(52) U.S. Cl.
CPC ..... *A63B 21/153* (2013.01); *A63B 21/0058* (2013.01); *A63B 21/157* (2013.01); *A63B 21/16* (2013.01)

(58) Field of Classification Search
CPC . A63B 21/153; A63B 21/0058; A63B 21/157; A63B 21/16; A63B 21/005; A63B 21/00058; A63B 21/22
See application file for complete search history.

(56) References Cited

U.S. PATENT DOCUMENTS 3,704,886 A * 12/1972 Kay ..... A63B 21/00069 482/62
4,979,733 A * 12/1990 Prud'Hon ..... A63B 21/153 482/901

(Continued)

FOREIGN PATENT DOCUMENTS

CN 112370716 A * 2/2021 ..... A63B 23/12
CN 217886887 U * 11/2022 ..... A63B 21/0058
WO WO-2022111184 A1 * 6/2022 ..... A63B 23/12

*Primary Examiner* — Andrew S Lo

(74) *Attorney, Agent, or Firm* — FIDELI LAW PLLC; Qiang Li

(57) ABSTRACT

The invention pertains to a fitness device comprising a resistance resource; a winding reel; a rally rope; a rotating member coaxially connecting to the winding reel, one end of the rally rope connecting to the winding reel, the other end cooperates with the pulling action of a user, the resistance source drives the winding reel to rotate so that the rally rope is wound to generate counterweight tension by outputting torque from the rotating member; a first support member limiting the resistance source on an external object, a linkage clutching mechanism for separating or linking the rotating members or the winding reels. The winding reels driven by two adjacent resistance sources are connected via the spline shaft, drives the resistance sources to rotate synchronously to increase torque, reduces production costs, improves the applicability of the fitness device, and makes it energy-saving and environmentally friendly.

10 Claims, 9 Drawing Sheets

(56) References Cited

U.S. PATENT DOCUMENTS

| | | | | |
|---|---|---|---|---|
| 5,133,545 | A * | 7/1992 | Moschetti | A63B 21/153 482/110 |
| 6,030,321 | A * | 2/2000 | Fuentes | A63B 21/4013 482/74 |
| 6,790,163 | B1 * | 9/2004 | Van De Laarschot | A63B 21/0056 434/254 |
| 11,179,590 | B1 * | 11/2021 | Nicholas | A63B 21/0051 |
| 2002/0086779 | A1 * | 7/2002 | Wilkinson | A63B 23/1263 482/118 |
| 2018/0001128 | A1 * | 1/2018 | Norris | A63B 21/0058 |
| 2018/0214730 | A1 * | 8/2018 | Larose | A61H 1/0237 |
| 2021/0283463 | A1 | 9/2021 | Wang | |
| 2021/0353994 | A1 * | 11/2021 | Paz Domonte | A63B 21/153 |
| 2022/0168606 | A1 * | 6/2022 | Herring | A63B 21/153 |
| 2023/0310940 | A1 * | 10/2023 | Lee | A63B 21/0058 482/4 |

* cited by examiner

MULTI-MOTOR FITNESS DEVICE

1. CROSS-REFERENCE TO RELATED APPLICATIONS

The application claims priority to Chinese patent application No. 202410824018.7, filed on Jun. 25, 2024, the entire contents of which are incorporated herein by reference.

2. TECHNICAL FIELD

The invention pertains to the field of fitness device, and particularly discloses a multi-motor fitness device.

BACKGROUND

As a common fitness device, the pull training device adopts a motor as a resistance source to pull the rope in opposite directions, thereby assisting users to perform training. At present, most of the pull training devices adopt an external rotor motor as a resistance source. This motor requires high torque and low speed to ensure sufficient resistance while maintaining stable operation. To meet the need of high torque and low speed, rare earth high-strength magnetic materials is required. This material has high production costs and is prone to certain negative impacts on the environment. Therefore, the current pull training device has high production costs, also excessively dependent on rare earth resources, and environmentally unfriendly.

SUMMARY

In order to overcome the shortcomings and deficiencies in the existing technology, the purpose of the present invention is to provide a multi-motor fitness device to solve the above-mentioned problems.

In accordance with an aspect of the embodiment, there is provided a multi-motor fitness device, comprising a resistance resource; a winding reel; a rally rope; a first support member; and a linkage clutching mechanism, wherein a rotating member of the resistance resource is coaxially connected to the winding reel, one end of the rally rope is connected to the winding reel, the other end of the rally rope is configured to cooperate with the pulling action of a user, the resistance source drives the winding reel to rotate so that the rally rope is wound on the winding reel by outputting torque via the rotating member; the first support member is configured to limit the resistance source on an external object, a plurality of the resistance sources are provided, the rotating members of two adjacent resistance sources are arranged close to each other, the linkage clutching mechanism is configured to separate or link the rotating members or the winding reels of two adjacent resistance sources from each other.

Preferably, the multi-motor fitness device further comprises a spline sleeve, a spline shaft is provided on the winding reel or the rotating member, the spline sleeve is movably arranged along the central axis direction of the spline shaft, the spline sleeve and a spline teeth of two adjacent spline shafts are fitted so that the winding reel of two adjacent resistance sources rotate in conjunction with each other; the spline sleeve is only sleeved on the winding reel of one resistance source so that the winding reel of two adjacent resistance sources rotate independently and separately from each other, the spline sleeve and the spline shaft are combined to form the linkage clutching mechanism.

Preferably, the spline shaft is fixedly connected to the winding reel by a detachable fastener, the linkage clutching mechanism further includes a restricting member, the restricting member is configured to limit the spline sleeve on the spline shaft so as to prevent the spline sleeve from moving relative to the central axis direction of the spline shaft.

Preferably, the length of a spline groove of the spline sleeve is less than or equal to the length of the spline teeth of any spline shaft meshing therewith.

Preferably, the resistance source is an external rotor motor, the external rotor motor includes a rotor, the rotor serves as the rotating member and is rotatably sleeved on the outside of the first support member, the winding reel is hollow inside and sleeved on the outside of the first support member, one end of the rotating member and/or the winding reel is provided with a first bearing fixing portion for mounting a bearing.

Preferably, the first support member is provided with a locking mechanism at both ends, the locking mechanism comprises a movable base and a fixed base, the movable base is arranged at one end of the first support member away from the resistance source, and the fixed base is slidably cooperated with the movable base, one end of the fixed base is configured to contact and cooperate with a bearing surface for bearing the external objects, the other end of the fixed base is provided with an inclined first guiding surface, the end of the movable base close to the fixed base is provided with an inclined second guiding surface, the first guiding surface and the second guiding surface are in contact with each other, the sum of the angle between the first guiding surface and a horizontal plane and the angle between the second guiding surface and the horizontal plane is 180°; when the movable base moves forward relative to the fixed base, the second guiding surface pushes the first guiding surface to firmly abut and limit the end of the fixed base away from the movable base on the bearing surface of the external object; when the movable base moves backward relative to the fixed base, the second guiding surface moves away from the first guiding surface to separate the end of the fixed base away from the movable base from the bearing surface of the external object.

Preferably, a retractable extension rod is arranged at both ends of the first support member, the movable base is arranged at one end of the extension rod away from the first support member.

Preferably, a buffer plate is provided at one end of the fixed base away from the first guiding surface, the hardness of the buffer plate is less than the hardness of the fixed base and the external object, the surface roughness of the buffer plate is greater than or equal to the surface roughness of the bearing surface of the external object.

Preferably, the multi-motor fitness device further comprises a suction assembly used in conjunction with the first support member, the suction assembly includes a supporting post connected to both ends of the first support member and a vacuum suction cup arranged at the end of the supporting post, the vacuum suction cup is configured to attach to a bearing surface of the external object to stabilize the first support member.

Preferably, the multi-motor fitness device further comprises a speed reducing mechanism, an output shaft and an input shaft of the speed reducing mechanism are respectively fixedly connected to the winding reel of two adjacent resistance source, so that the winding reel of the two adjacent resistance sources have different rotation speeds, the speed reducing mechanism is the linkage clutching mechanism.

Compared with the existing technology, the present disclosure has the following advantages and beneficial effects. The present disclosure increases torque by driving two or more motors to rotate synchronously, and is provided with a pluralities of external rotor motors and connects the rotating members or the winding reels of two adjacent external rotating motors via the spline shaft and the spline sleeve. Alternatively, the speed reducing mechanism connects the rotating members or the winding reels of two adjacent external rotating motors. When the rally rope driven by one motor is pulled, the rally rope driven by the other motor will be decelerated during pulling and thus a greater load is generated. It reduces the need of rare earth high-strength magnetic materials in the external rotor motors greatly, significantly improves the applicability of the fitness device, reduces the production cost, and makes it energy-saving and environmentally friendly.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE EMBODIMENTS

Figure 1:
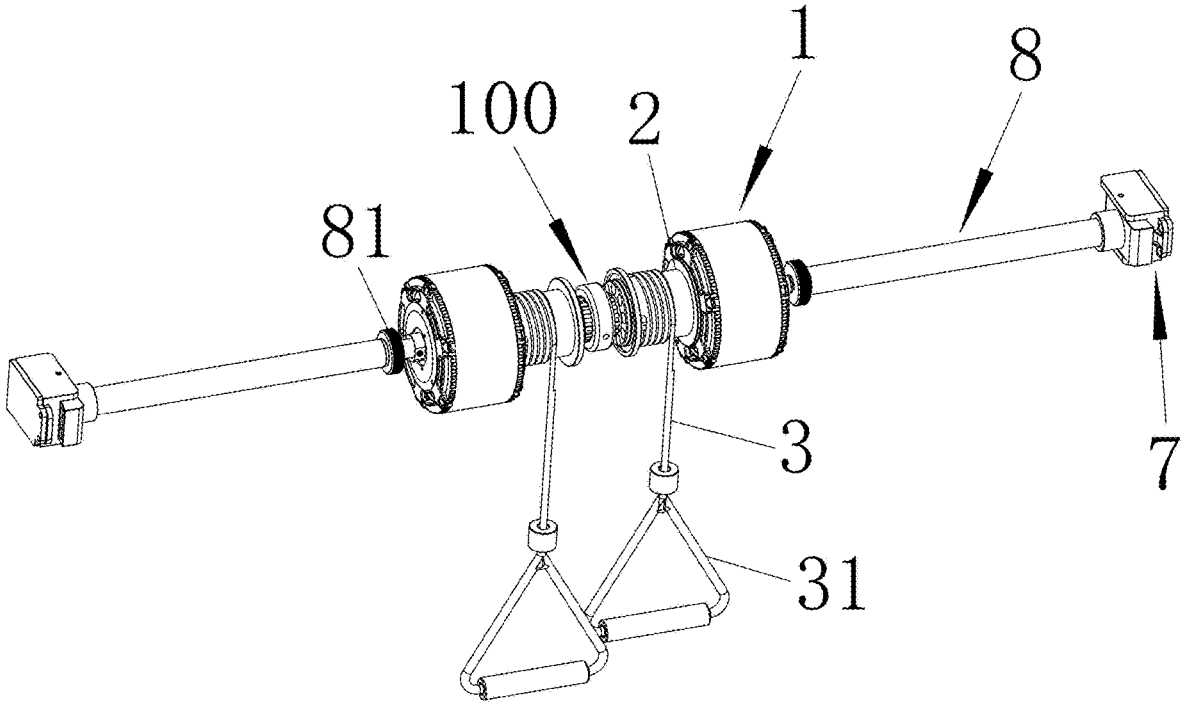
FIG. 1 is a schematic view of the present disclosure.
Figure 2:
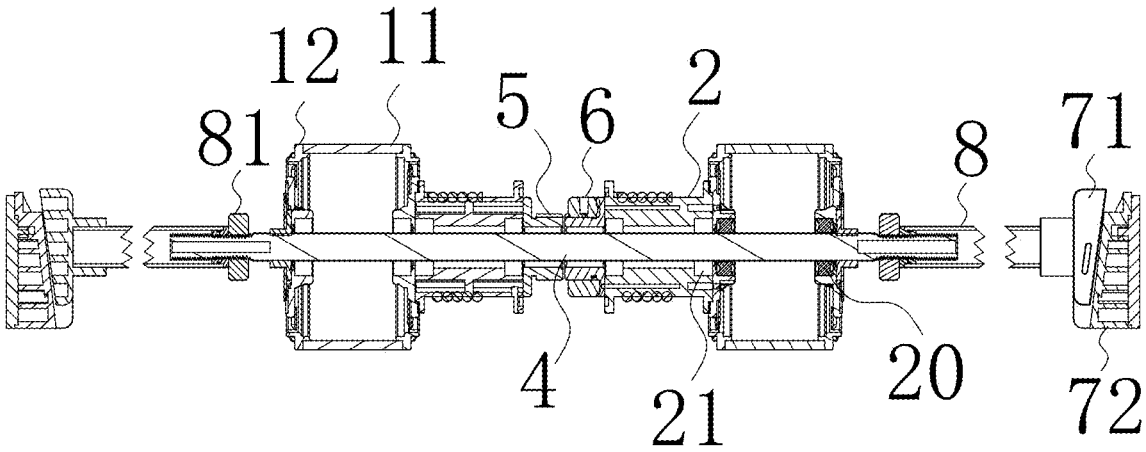
FIG. 2 is a cross-section view of the present disclosure.
Figure 3:
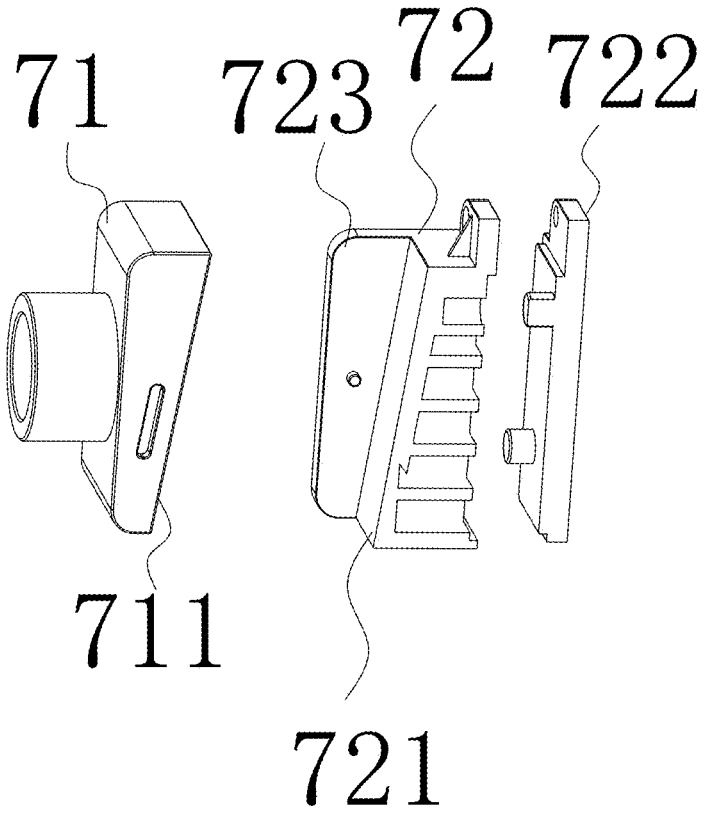
FIG. 3 is a schematic view of the locking mechanism provided by the present disclosure.
Figure 4:
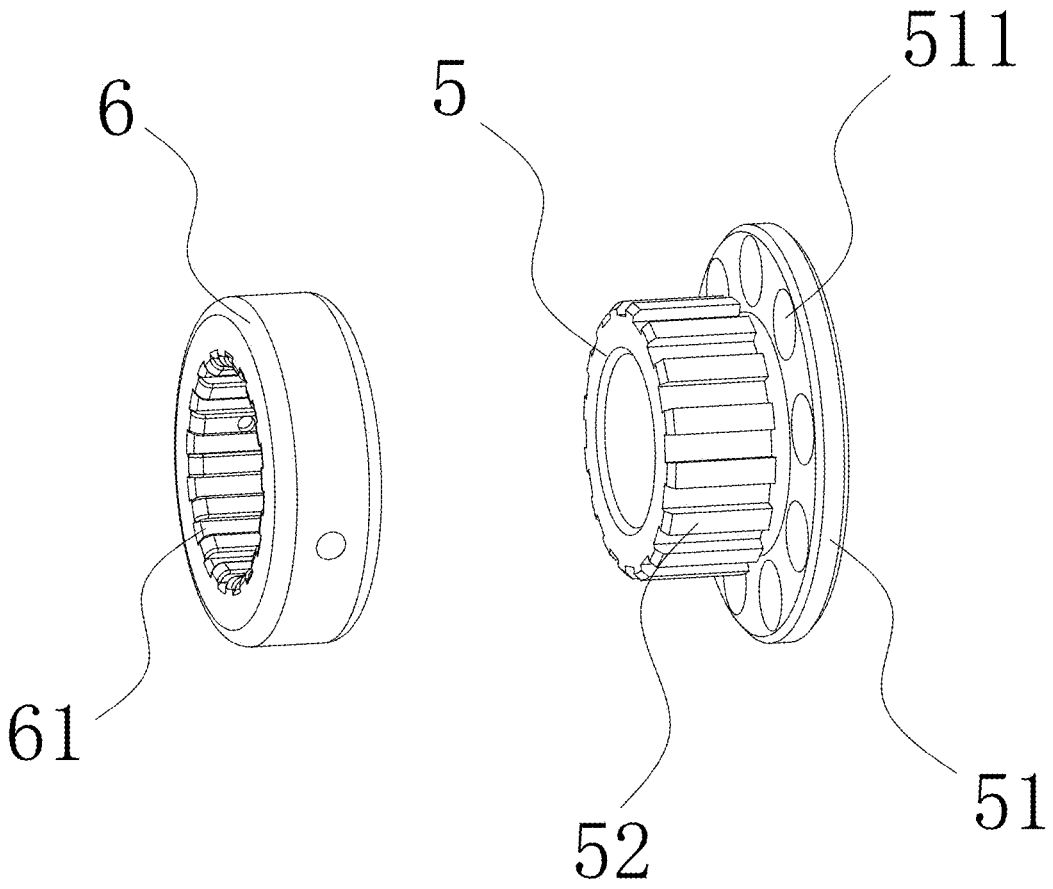
FIG. 4 is a partially exploded view of the linkage clutching mechanism provided by the present disclosure.
Figure 5:
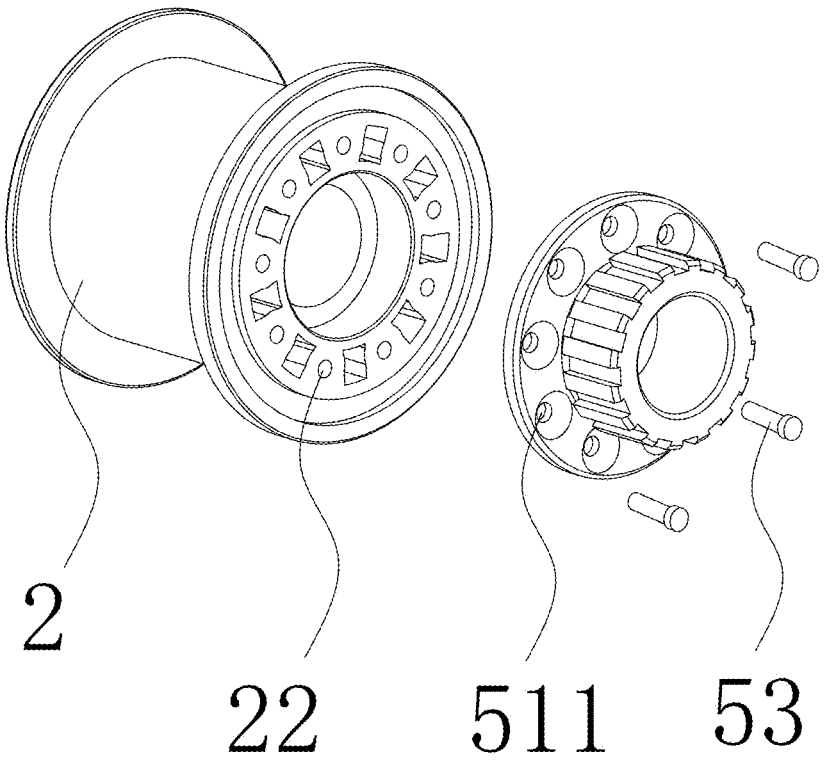
FIG. 5 is a schematic view of the winding reel and the spine shaft.
Figure 6:
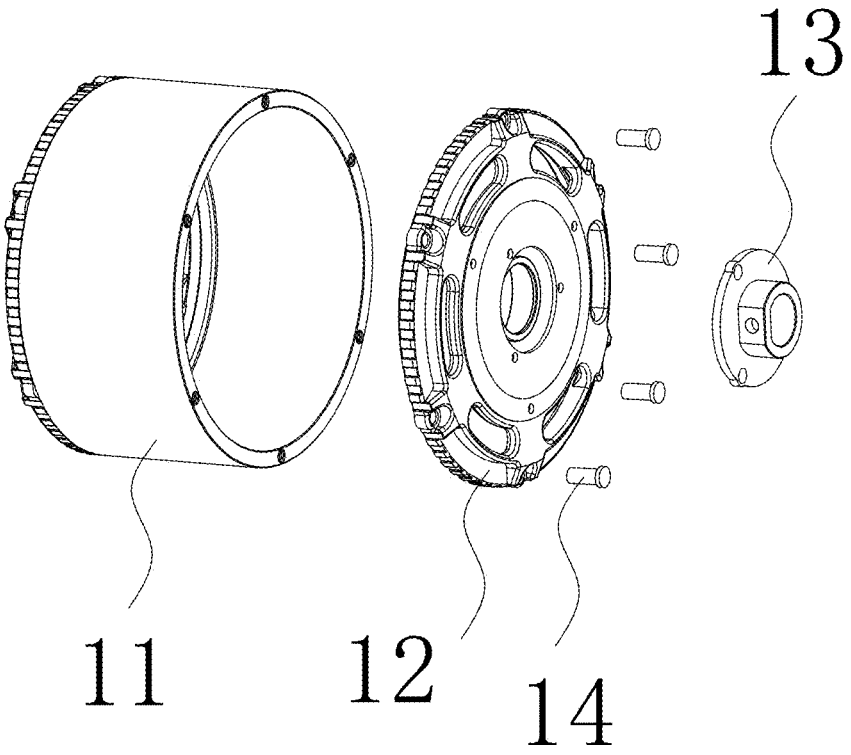
FIG. 6 is a schematic view of the rotating member, the protective housing and the thread locking ring provided by the present disclosure.
Figure 7:
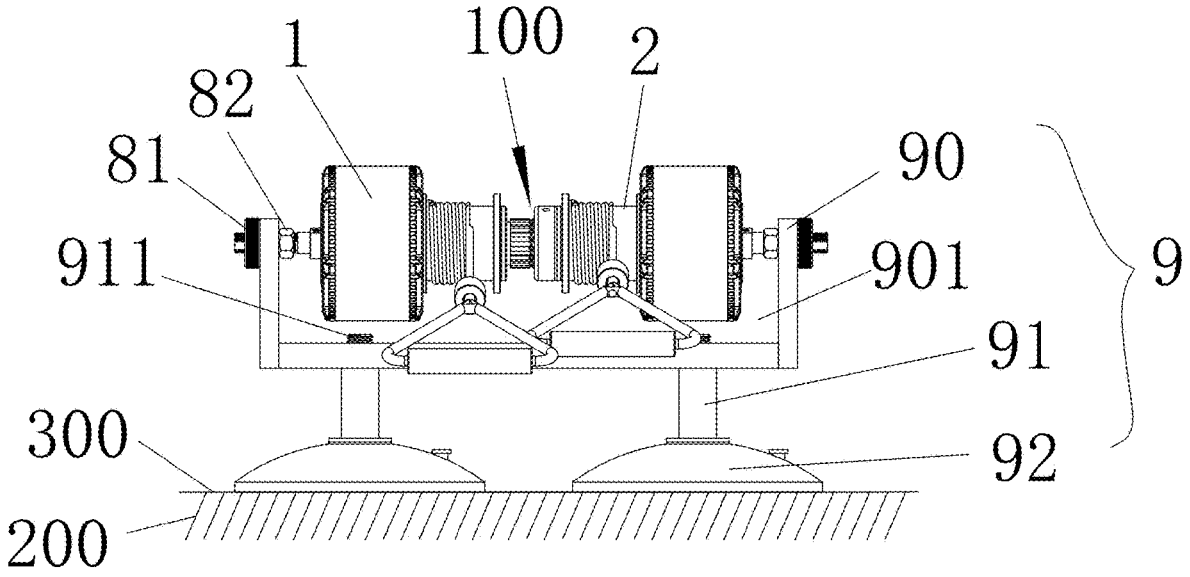
FIG. 7 is a schematic view of the the fitness device placed on the external object (i.e. ground) provided by the present disclosure.

The invention will be further described below in details with reference to the figures and embodiments.

Please refer to FIG. 1 to FIG. 9, the specific structure of a preferred embodiment of the present invention is shown, which is a multi-motor fitness device, comprises a resistance resource 1, a winding reel 2, and a rally rope 3. A rotating member 11 of the resistance resource 1 is coaxially connected to the winding reel 2, one end of the rally rope 3 is connected to the winding reel 2, the other end of the rally rope 3 is used to cooperate with the pulling action of a user, the resistance source 1 drives the winding reel 2 to rotate so that the rally rope 3 is wound on the winding reel 2 by outputting torque from the rotating member 11. The fitness device further comprises a first support member 4 and a linkage clutching mechanism 100, the first support member 4 is used to limit the resistance source 1 on an external object 200, a plurality of the resistance sources 1 are provided, the rotating members 11 of two adjacent resistance sources 1 are arranged close to each other, the linkage clutching mechanism 100 is used to separate or link the rotating members 11 or the winding reels 2 of two adjacent resistance sources 1 from each other.

In the embodiment of the disclosure, the resistance source 1 is an external rotor motor, the external rotor motor includes a rotor serving as the rotating member 11 and fixedly connected to the winding reel 2. One end of the rally rope 3 is fixedly connected to the winding reel 2, the other end of the rally rope 3 is provided with a detachable handle 31. When using the fitness device for pull training, the user holds the handle 31 and pulls the rally rope 3, at this time, the external motor outputs torque via the rotor to drive the winding reel 2 to rotate, so that the rally rope 3 is wound on the winding reel 2, thereby generating a counterweight tension. The pulling resistance requires the user to overcome it through muscle strength, in order to achieve the purpose of muscle training. Two winding reels 2 are coaxially connected via a spline shaft 5 and a spline sleeve 6. The user can generate greater force by pulling the rally rope 3, improving the applicability of the fitness device.

Specifically, the fitness device furtherly comprises the spline sleeve 6, the spline shaft 5 is provided on the winding reel 2 or the rotating member 11, the spline sleeve 6 is movably arranged along the central axis direction of the spline shaft 5, the spline sleeve 5 and a spline teeth 52 of two adjacent spline shafts 5 are fitted so that the winding reel 2 of two adjacent resistance sources 1 rotate in conjunction with each other; the spline sleeve 6 is only sleeved on the winding reel 2 of one resistance source 1 so that the winding reel 2 of two adjacent resistance sources 1 rotate independently and separately from each other, and the spline sleeve 6 and the spline shaft 5 are combined to form the linkage clutching mechanism 100. Specifically, the spline shaft 5 is fixedly connected to the winding reel 2 by a detachable fastener 53; the linkage clutching mechanism 100 further includes a restricting member 62, the restricting member 62 is used to limit the spline sleeve 6 on the spline shaft 5 so as to prevent the spline sleeve 6 from moving relative to the central axis direction of the spline shaft 5. The restricting member 62 is retractable and arranged on the spline sleeve 6. In actual use, the restricting member 62 is pressed to extend into the gap between two adjacent spline shafts 5 to prevent the spline sleeve 6 from radially displacing relative to the spline shafts 5. In this embodiment, the winding reel 2 is hollow cylindrical shaped, the longitudinal section of the winding reel 2 is "I"-shaped. A plurality of tapped bores 22 are arranged on the peripheral side of the winding drum 2. The middle part of the spline shaft 5 is hollow and the edge protrudes outwardly to form a connecting member 51, the connecting member 51 is plate-shaped. The connecting member 51 is provided with a plurality of through holes 511 communicating with the tapped bores 22, and the spline shaft 5 is threadedly connected to the winding reel 2 via the connecting member 51. In actual production, a pin hole connection is alternatively defined.

Specifically, the length of a spline groove 61 of the spline sleeve 6 is less than or equal to the length of the spline teeth 52 of any spline shaft 5 meshing therewith. In actual use, the spline sleeve 6 is slidably arranged on the spline shaft 5. When a single resistance source 1 is used for pulling training, it allows the spline sleeve 6 to be reasonably defined without protruding from the spline shaft 5, thereby saving storage space.

Specifically, the resistance source 1 is an external rotor motor, the external rotor motor includes a rotor, the rotor serves as the rotating member 11 and is rotatably sleeved on the outside of the first support member 4, the winding reel 2 is hollow inside and sleeved on the outside of the first support member 4, one end of the rotating member 11 and/or the winding reel 2 is provided with a first bearing fixing portion 21 for mounting a bearing 20. In this embodiment, the rotating member 11 is annular, and the first support member 4 is cylindrical. Two ends of the rotating member 11 are fixedly connected with a protective housing 12 by a bolt 14. The protective housing 12 is rotatably connected to the first support member 4 via a thread locking ring 13. The first bearing fixing portion 21 of the rotor is arranged in the protective housing 12 and is integrated with the protective housing 12. The threaded locking ring 13 connects the first support member 4 and the protective housing 12, so the connection is tighter and easy to disassemble. In actual production, a flat key and a keyway are preferably selected to achieve the fixed connection of the first support member 4 and the protective housing 12.

Specifically, the first support member 4 is provided with a locking mechanism 7 at both ends, the locking mechanism 7 comprises a movable base 71 and a fixed base 72, the movable base 71 is arranged at one end of the first support member 4 away from the resistance source 1, and the fixed base 72 is slidably cooperated with the movable base 71, one end of the fixed base 72 is used to contact and cooperate with a bearing surface 300 for bearing the external objects 200, the other end of the fixed base 72 is provided with an inclined first guiding surface 721, the end of the movable base 71 close to the fixed base 72 is provided with an inclined second guiding surface 711, the first guiding surface 721 and the second guiding surface 711 are in contact with each other, the sum of the angle between the first guiding surface 721 and a horizontal plane and the angle between the second guiding surface 711 and the horizontal plane is 180°. When the movable base 71 moves forward relative to the fixed base 72, the second guiding surface 711 pushes the first guiding surface 721 to firmly abut and limit the end of the fixed base 72 away from the movable base 71 on the bearing surface 300 of the external object 200; when the movable base 71 moves backward relative to the fixed base 72, the second guiding surface 711 moves away from the first guiding surface 721 to separate the end of the fixed base 72 away from the movable base 71 from the bearing surface 300 of the external object 200. In this embodiment, the cross section of the movable base 71 and the fixed base 72 are roughly trapezoidal, and the trapezoidal movable base 71 and the trapezoidal fixed base 72 form a rectangular combination after being matched. The end of the fixed base 72 away from the movable base 71 is used to abut against a wall or a door frame, thus the applicable scenarios is broadened. A plurality of blind grooves (not shown) are provided at one end of the fixed base 72 away from the movable base 71. The plurality of blind grooves are arranged to reduce the strength of the fixed base 72, so that the movable base 71 is squeezed and slightly deformed to fit tightly with the bearing surface of the external object. The blind groove is also used to install the buffer plate 722.

Specifically, one end of the fixed base 72 close to the movable base 71 is provided with two limiting baffles 723 for guiding the movable base 71. When there is a need to fix the first support member 4 with the wall or the door frame, the movable base 71 is firstly engaged with the fixed base 72 via the guiding of the limiting baffle 723, then the movable base 71 is slid. Since two guiding surfaces are inclined and parallel to each other, this movement will cause the movable base 71 to generate a force perpendicular to the direction of the guiding surface. As the first support member 4 is fixedly connected to the movable base 71, the first support member 4 pushes the movable base 71 and the fixed base 72 towards the wall or the door frame with this force. When the user performs pulling exercise, this force will be further strengthened so as to connect the first support member 4 and the wall or the door frame tightly.

Specifically, a retractable extension rod 8 is arranged at both ends of the first support member 4, the movable base 71 is arranged at one end of the extension rod 8 away from the first support member 4. In this embodiment, the extension rod 8 is defined in a hollow cylindrical shape. An annular adjusting wheel 81 is provided at one end of the extension rod 8 close to the first support member 4. The inner wall of the adjusting wheel 81 is provided with an internal thread 811, the end of the first support member 4 is provided with a first external thread portion 41 threadedly engaged with the internal thread. In use, the adjusting wheel 81 rotates and links the extension rod 8 to reciprocate on the first support member 4 to achieve a retractable connection. This design is simple and reliable, and the production cost is further decreased.

Specifically, a buffer plate 722 is provided at one end of the fixed base 72 away from the first guiding surface 721, the hardness of the buffer plate 722 is less than the hardness of the fixed base 72 and the external object, the surface roughness of the buffer plate 722 is greater than or equal to the surface roughness of the bearing surface 300 of the external object 200. The buffer plate 722 is made of silicone material and is detachably connected to the fixed base 72, so that it is easily disassembled and replaced. The buffer plate 722 made of silicone material provides cushioning and protection when it collides with the bearing surface, while increasing friction and improving connection stability.

Specifically, the multi-motor fitness device further comprises a suction assembly 9 in conjunction with the first support member 4, the suction assembly 9 includes a supporting post 91 connected to both ends of the first support member 4 and a vacuum suction cup 92 arranged at the end of the supporting post 91, the vacuum suction cup 92 is configured to attach to the bearing surface of the external object to stabilize the first support member 4. The extension direction of the supporting post 91 is perpendicular to the extension direction of the first support member 4. In use, the first support member 4 is parallel to the ground, the vacuum suction cup 92 is adsorbed on the flat ground to achieve a fixed connection between the fitness device and the ground, then pulling action is performed.

Specifically, the suction assembly 9 also includes a connecting frame 90 arranged concave shaped. A concave portion 901 of the connecting frame 90 is used to accommodate the resistance source 1 and the winding reel 2. Two ends of the first support member 4 are detachably connected to the connecting frame 90 via a nut 82. In this embodiment, the first external thread portion 41 of the first support member 4, the adjusting wheel 81 and the nut 82 are detachably connected. When in use, the nut 82 is first screwed into one end of the first external thread portion 41; then the first support member 4 is placed on the connecting frame 90 so that the other end of the first external thread portion 41 protrudes out of the connecting frame 90; then the adjusting wheel 81 is screwed into the other end of the first external thread portion 41 so that the nut 82 and the adjusting wheel 81 clamp the connecting frame 90, then the first support member 4 is stably limited on the connecting frame 90 by the reverse tightening of the adjusting wheel 81 and the nut 82. This structure is simple, the connection stability is strong, and it is easy to disassemble and repair, which helps to optimize the production cost of the fitness device.

During installation, two adjusting wheels 81 or two nuts 82 is alternatively used to lock the first support member 4 and the connecting frame 90. A free end of the supporting post 91 is provided with a threaded section, the vacuum suction cup 92 is connected to the bottom thread of the connecting frame 90 via the supporting post 91. The stable connection between the fitness device and the ground is achieved via the cooperation of the vacuum suction cup 92 and the connecting frame 90. The structure is simple and easy to disassemble.

Figure 8:
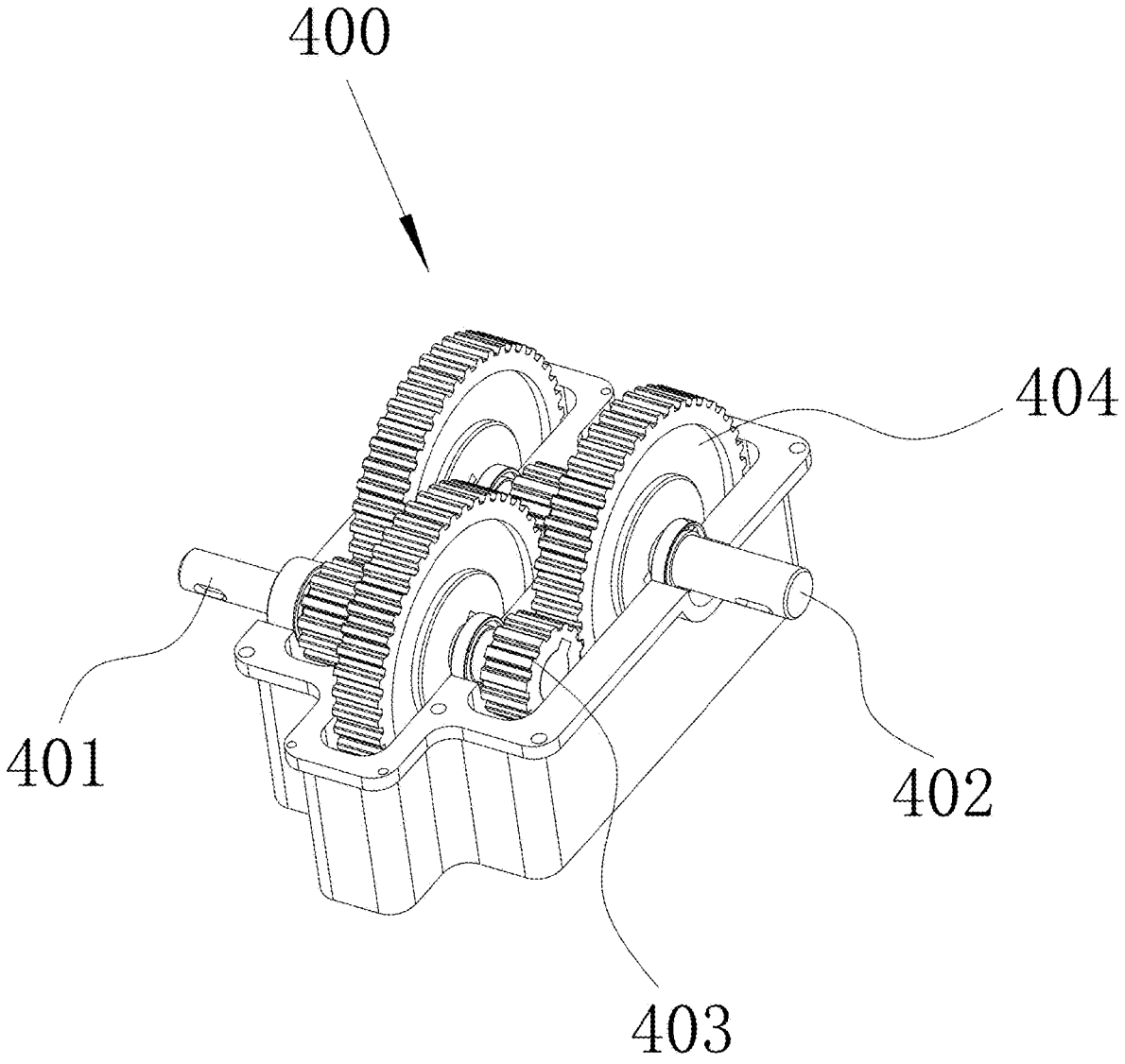
FIG. 8 is a schematic view of the speed reducing mechanism.
Figure 9:
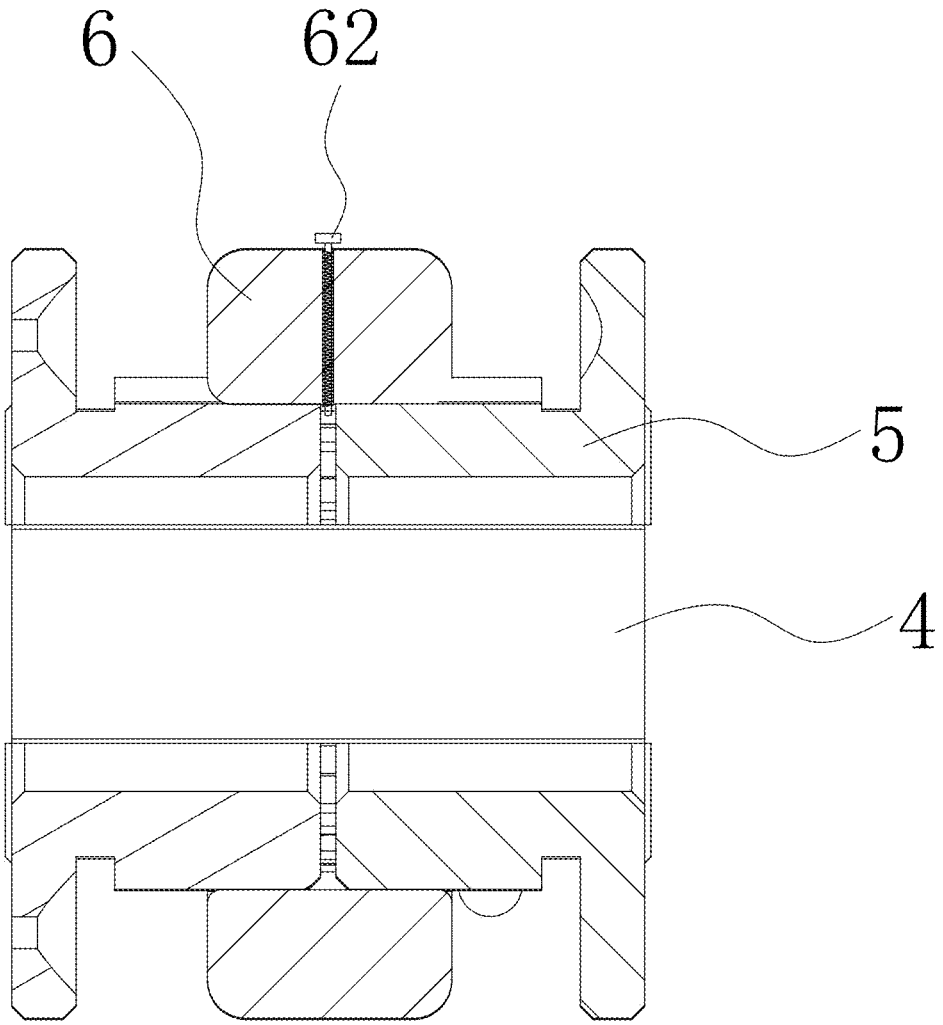
FIG. 9 is a sectional view of the linkage clutching mechanism.

Specifically, as shown in FIG. 8, the multi-motor fitness device further comprises a speed reducing mechanism 400, the speed reducing mechanism 400 is a gear reduction mechanism. The speed reduction mechanism 400 is composed of an input shaft 401, three small gears 403, three large gears 404 (the diameter of which is larger than that of the small gears), and an output shaft 402, which are connected to each other in a transmission manner and form a three-stage speed reduction. An output shaft 402 and an input shaft 401 of the speed reducing mechanism 400 are respectively fixedly connected to the winding reels 2 of two adjacent resistance sources 1, so that the winding reels 2 of the two adjacent resistance sources 1 have different rotation speeds, thereby realizing personalized training for users. The gear speed reduction mechanism is the linkage clutching mechanism 100.

Specifically, in use, two adjacent winding reels 2 are connected through a plurality of toothed belts and a plurality of pulleys, the multiple pulleys are respectively defined with different diameters. For example, the pulley with larger diameter is used as a driving wheel and connected to one of the first winding reels 2, the pulley with a small diameter is used as a driven wheel and connected to the other winding reel 2. When one of the winding reel 2 rotates under the driving of the resistance source 1, the driven wheel rotates at different speeds. When the rally rope 3 on one of the winding reel 2 is pulled, the other winding reel 2 is decelerated, thus the force increases. When the rally rope 3 on the other winding reel 2 is pulled, the former winding reel 2 acts as a driven wheel, causing its speed to increase and the force to decrease.

Specifically, with the reduction mechanism, the users are able to adjust the resistance output of two motors independently based on their own condition to achieve personalized fitness training. If one of the motors malfunctions, the other motor continues to work and ensures that the user is able to continue exercising. In addition, the reduction mechanism reduces the load of the external motor and prolongs its service life by reducing the speed and increasing the torque.

The above embodiments, which are intended to enable those skilled in the art to understand the content of the disclosure and implement it accordingly, are merely for describing the technical concepts and features of the disclosure, and the scope of patent application of the disclosure cannot be defined only by the embodiments, i.e., any equivalent variations or modifications made in accordance with the spirit disclosed by the disclosure still fall within the scope of claims of the disclosure.

What is claimed is:

1. A multi-motor fitness device, comprising:

a resistance resource;

a winding reel;

a rally rope;

a first support member; and a linkage clutching mechanism, wherein a rotating member of the resistance resource is coaxially connected to the winding reel, one end of the rally rope is connected to the winding reel, the other end of the rally rope is configured to cooperate with the pulling action of a user, a resistance source drives the winding reel to rotate so that the rally rope is wound on the winding reel by outputting torque via the rotating member;

the first support member is configured to limit the resistance source on an external object, a plurality of the resistance sources are provided, the rotating members of two adjacent resistance sources are arranged close to each other, the linkage clutching mechanism is configured to separate or link the rotating members or the winding reels of two adjacent resistance sources from each other.

2. The multi-motor fitness device as defined in claim 1, further comprising a spline sleeve, wherein a spline shaft is provided on the winding reel or the rotating member, the spline sleeve is movably arranged along a central axis direction of the spline shaft, the spline sleeve and a spline teeth of two adjacent spline shafts are fitted so that the winding reels of two adjacent resistance sources rotate in conjunction with each other, the spline sleeve is only sleeved on the winding reel of one resistance source so that the winding reels of two adjacent resistance sources rotate independently and separately from each other, the spline sleeve and the spline shaft are combined to form the linkage clutching mechanism.

3. The multi-motor fitness device as defined in claim 2, wherein the spline shaft is fixedly connected to the winding reel by a detachable fastener, the linkage clutching mechanism further includes a restricting member, the restricting member is configured to limit the spline sleeve on the spline shaft so as to prevent the spline sleeve from moving relative to the central axis direction of the spline shaft.

4. The multi-motor fitness device as defined in claim 2, wherein a length of a spline groove of the spline sleeve is less than or equal to a length of the spline teeth of any spline shaft meshing therewith.

5. The multi-motor fitness device as defined in claim 1, wherein the resistance source is an external rotor motor, the external rotor motor includes a rotor, the rotor serves as the rotating member and is rotatably sleeved on outside of the first support member, the winding reel is hollow inside and sleeved on outside of the first support member, at least one of an end of the rotating member or the winding reel is provided with a first bearing fixing portion for mounting a bearing.

6. The multi-motor fitness device as defined in claim 1, wherein the first support member is provided with a locking mechanism at both ends, the locking mechanism comprises a movable base and a fixed base, the movable base is arranged at one end of the first support member away from the resistance source, and the fixed base is slidably cooperated with the movable base, one end of the fixed base is configured to contact and cooperate with a bearing surface for bearing the external objects, the other end of the fixed base is provided with an inclined first guiding surface, an end of the movable base close to the fixed base is provided with an inclined second guiding surface, the first guiding surface and the second guiding surface are in contact with each other, a sum of an angle between the first guiding surface and a horizontal plane and an angle between the second guiding surface and the horizontal plane is 180°;

when the movable base moves forward relative to the fixed base, the second guiding surface pushes the first guiding surface to firmly abut and limit the end of the fixed base away from the movable base on the bearing surface of the external object; when the movable base moves backward relative to the fixed base, the second guiding surface moves away from the first guiding surface to separate the end of the fixed base away from the movable base from the bearing surface of the external object.

7. The multi-motor fitness device as defined in claim 6, wherein a retractable extension rod is arranged at both ends of the first support member, the movable base is arranged at one end of the extension rod away from the first support member.

8. The multi-motor fitness device as defined in claim 6, wherein a buffer plate is provided at one end of the fixed base away from the first guiding surface, a hardness of the buffer plate is less than a hardness of the fixed base and the external object, a surface roughness of the buffer plate is greater than or equal to a surface roughness of the bearing surface of the external object.

9. The multi-motor fitness device as defined in claim 1, further comprising a suction assembly in conjunction with the first support member, wherein the suction assembly includes a supporting post connected to both ends of the first support member and a vacuum suction cup arranged at the end of the supporting post, the vacuum suction cup is configured to attach to a bearing surface of the external object to stabilize the first support member.

10. The multi-motor fitness device as defined in claim 1, further comprising a speed reducing mechanism, wherein an output shaft and an input shaft of the speed reducing mechanism are respectively fixedly connected to the winding reels of two adjacent resistance source, so that the winding reels of the two adjacent resistance sources have different rotation speeds, the speed reducing mechanism is the linkage clutching mechanism.

* * * * *